United States Patent [19]

Pohl

[11] 4,381,880

[45] May 3, 1983

[54] MULTIPLE ELECTRICAL CONNECTOR AND BLOCK

[75] Inventor: Karl-Heinz Pohl, Woodbury, Conn.

[73] Assignee: The Siemon Company, Waterton, Conn.

[21] Appl. No.: 269,551

[22] Filed: Jun. 9, 1981

Related U.S. Application Data

[63] Continuation of Ser. No. 184,665, Sep. 8, 1980, abandoned.

[51] Int. Cl.[3] ..... H01R 4/24

[52] U.S. Cl. ..... 339/97 P; 339/210 M

[58] Field of Search ..... 339/97 P, 98, 99 R, 339/198 R, 198 J, 206 R, 210 R, 210 M

[56] References Cited

U.S. PATENT DOCUMENTS

| | | | |
|---|---|---|---|
| 3,112,147 | 11/1963 | Pferd et al. | 339/97 P |
| 3,132,913 | 5/1964 | Pohl | 339/97 P |
| 3,963,319 | 6/1976 | Schumacher et al. | 339/99 R |
| 3,990,768 | 11/1976 | Faber | 339/210 R |
| 4,101,189 | 7/1978 | Moser et al. | 339/99 R |
| 4,171,857 | 10/1979 | Forberg et al. | 339/97 P |
| 4,255,009 | 3/1981 | Clark | 339/99 R |

*Primary Examiner*—John McQuade

*Attorney, Agent, or Firm*—David S. Fishman

[57] ABSTRACT

A mounting block for solderless connectors has a retainer and a body section which defines slots for housing terminal defining conductive elements to thereby define rows and columns of terminals. The conductive elements are formed from wire to define linearly aligned plural loops between which wires may be inserted. The block supports the conductive elements so that relative lateral movement between the loops is precluded.

34 Claims, 6 Drawing Figures

MULTIPLE ELECTRICAL CONNECTOR AND BLOCK

CROSS-REFERENCE TO RELATED APPLICATION

This application is a continuation of application Ser. No. 184,665 filed Sept. 8, 1980, now abandoned.

BACKGROUND OF THE INVENTION

This invention relates to the field of multiple electrical connectors and mounting blocks therefor. More particularly, this invention relates to a new and improved mounting block for wire formed solderless multiple connectors of the type shown in my prior U.S. Pat. No. 3,132,913, all of the contents of which are incorporated herein by reference.

My earlier U.S. Pat. No. 3,132,913 relates to a solderless multiple connector formed from continuous strips of wire formed and shaped in adjacent and abutting loops so as to receive and electrically contact electrically conductive wire between abutting sections of loops. The wire formed solderless connector shown in my prior U.S. Pat. No. 3,132,913 was intended as an improvement on and had several advantages over prior art clip type connectors of the type generally shown in U.S. Pat. No. 3,112,147 (of which I am a coinventor) and which are sometimes referred to in the art as "66 Type" connectors. However, the wire formed solderless multiple connector of my U.S. Pat. No. 3,132,913 has not come into widespread use prior to the present time; and I believe that is due, at least in part, to the unavailability of a suitable mounting block for such wire formed solderless multiple connectors.

SUMMARY OF THE INVENTION

The present invention overcomes the above briefly discussed and other deficiencies and disadvantages of the prior art by providing a novel and improved solderless connector of the multiple terminal type. Solderless connectors in accordance with the present invention comprise plural terminal defining elements and a housing which receives the terminal elements. The housing or terminal block is formed from a nonconductive material and comprises a main body section, which receives the terminal elements, to thereby define rows and columns of individual connectors, and means for mating with the body section to capture the terminal elements within the body section. The terminal elements are formed from conductive wire stock so as to have a plurality of linearly aligned loops with side portions of adjacent loops being in an abutting relationship. The connector block body section is provided with slots which receive the terminal elements and which preclude overlapping or other lateral movement of the opposite ends of the terminal element loops. The terminal elements thus function as end supported beams having straight sections which are capable of flexure whereby the terminal elements will exert force on a wire inserted between adjacent loops which is initially high and which decreases in the direction of wire insertion.

The body section of a connector in accordance with the present invention also defines a stop or floor intermediate the length of the terminal elements. This floor limits the depth to which a conductor may be inserted in the connector. This floor is located at or above the end of the abutting sections of the adjacent terminal element loops. A plurality of bridge elements extend upwardly from this floor and these bridge elements position and retain the terminal elements, which extend outwardly from a pair of opposite sides of each bridge element, and thus define the rows and columns of the connector.

Accordingly, one object of this invention is to provide a novel and improved mounting block for wire formed solderless multiple connectors.

Another object of this invention is to provide a novel and improved unit of a mounting block housing wire formed solderless multiple connectors.

Other objects and advantages of the present invention will be apparent to and understood by those skilled in the art by the following detailed description and drawings.

DESCRIPTION OF THE DRAWINGS

Referring now to the drawings, wherein like elements are numbered alike in the several FIGURES.

DESCRIPTION OF THE PREFERRED EMBODIMENT

Figure 1:
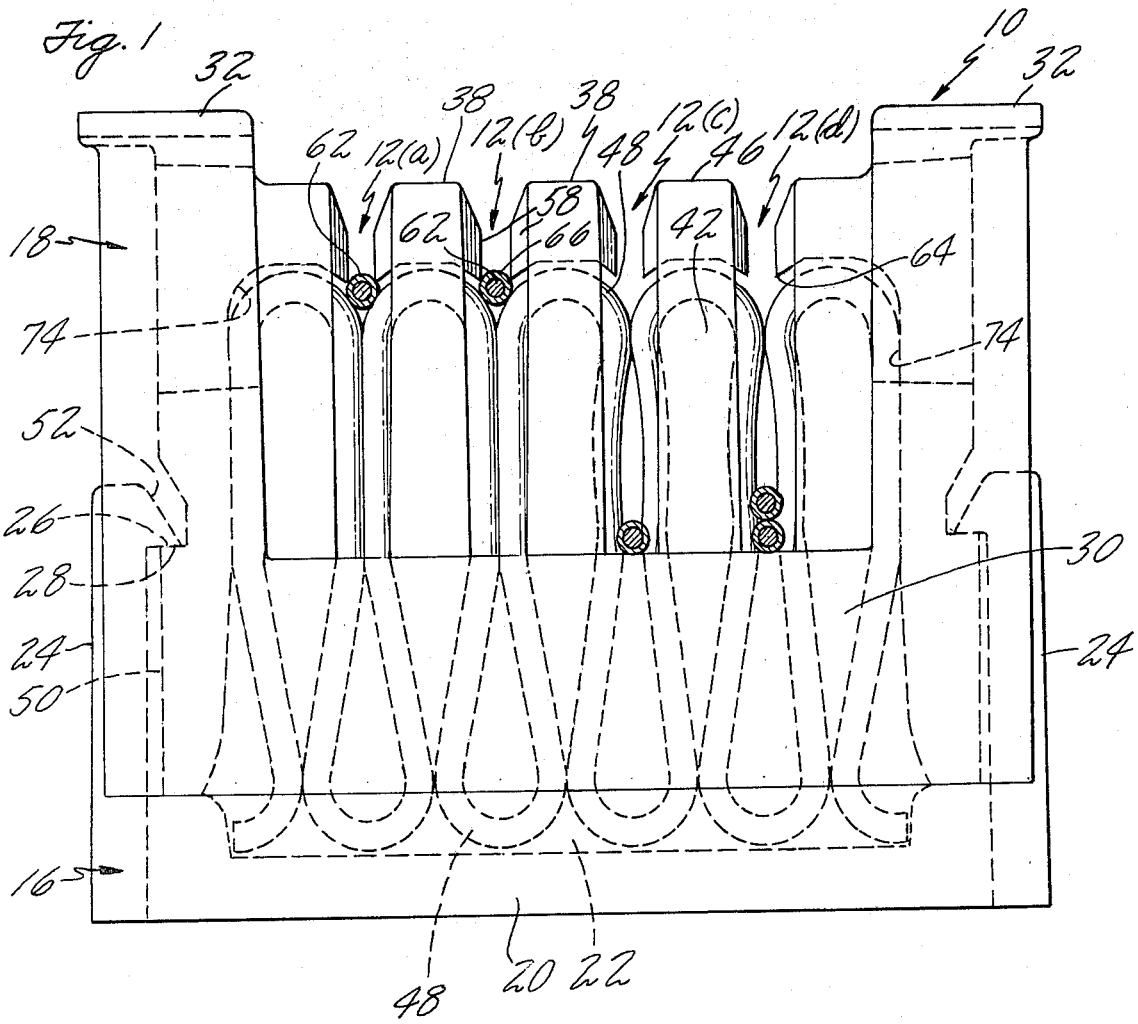
FIG. 1 is a front elevation view of the mounting block of the present invention.
Figure 2:
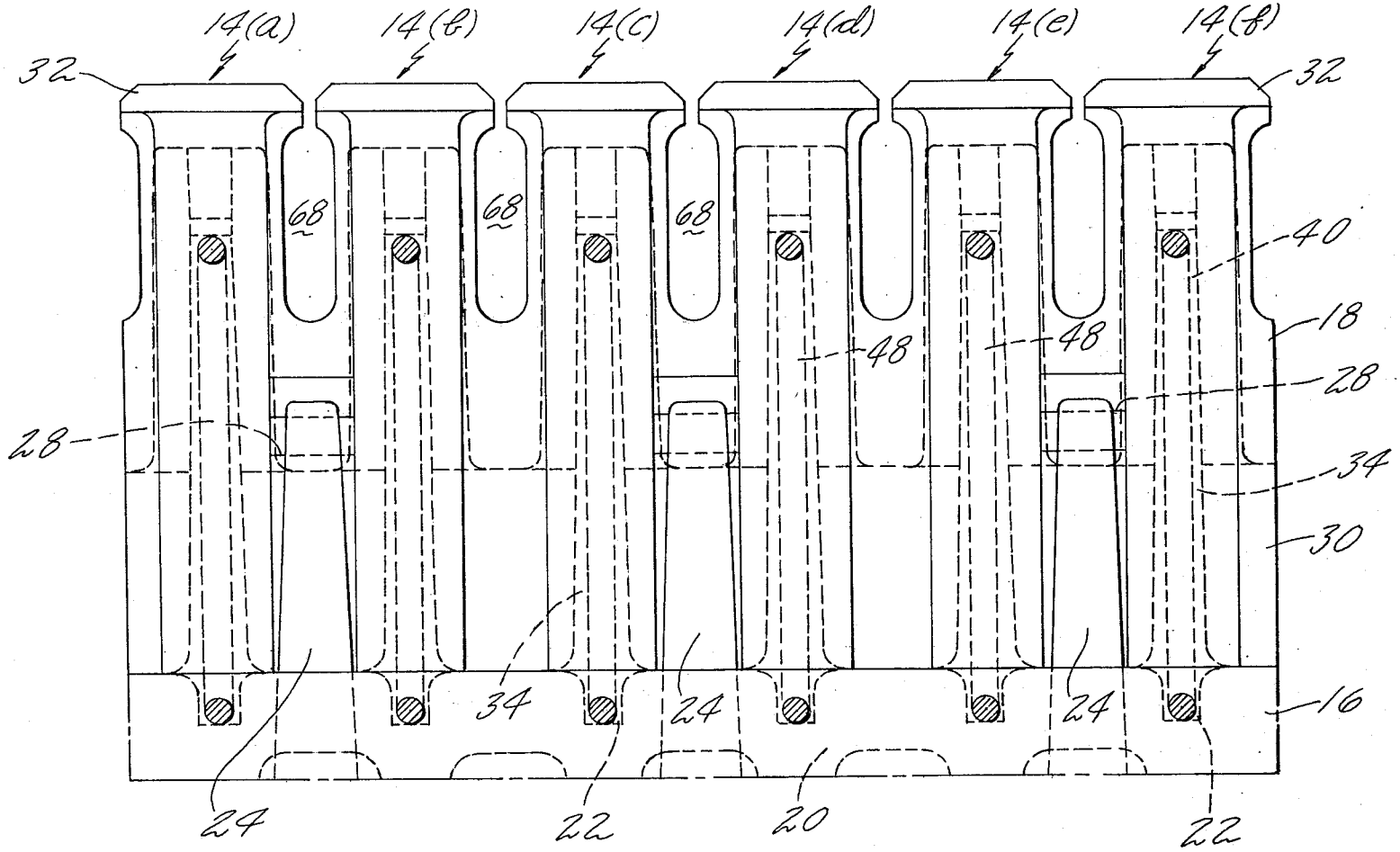
FIG. 2 is a side elevation view of the mounting block of FIG. 1.
Figure 3:
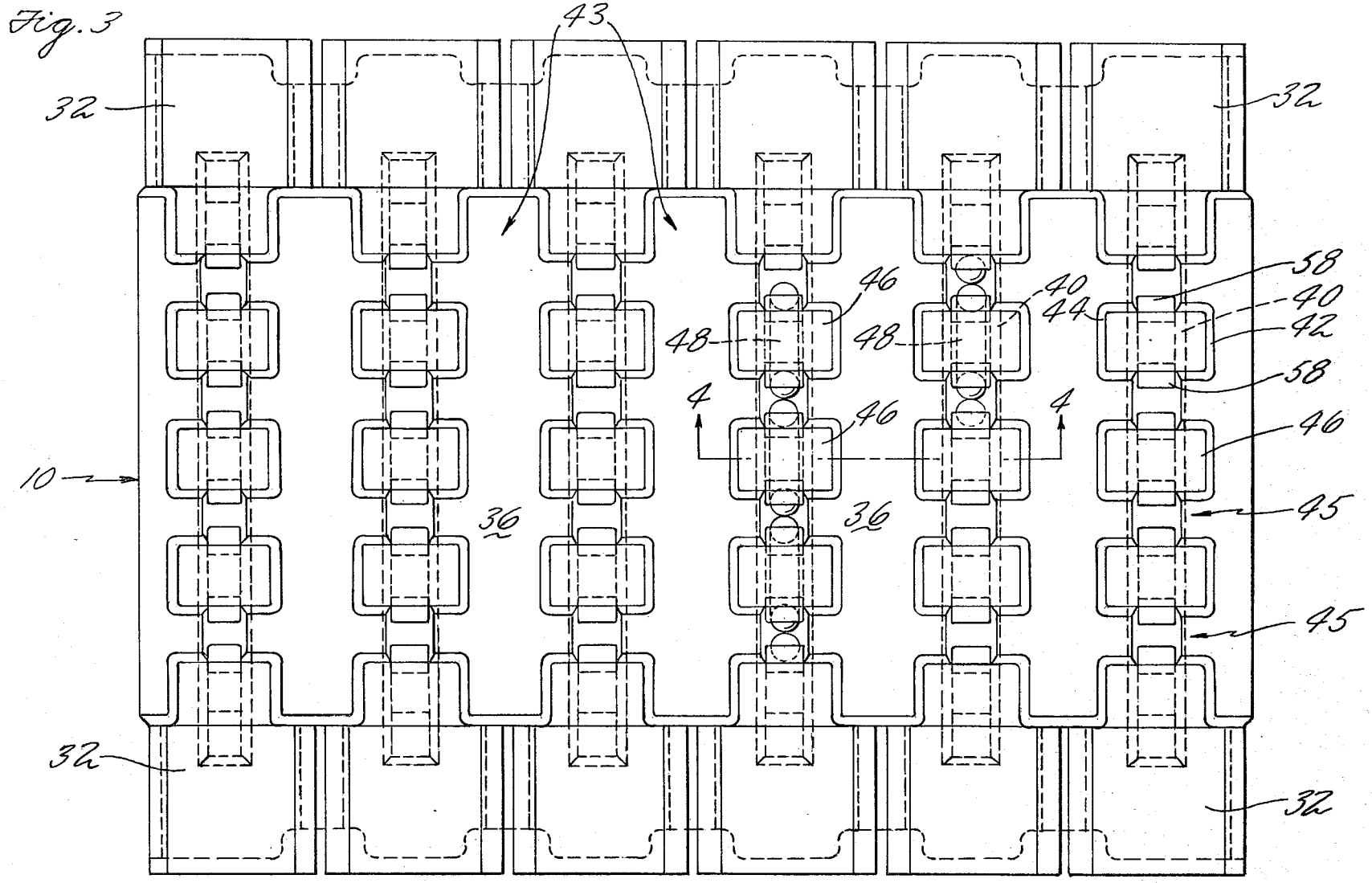
FIG. 3 is a top plan view of the mounting block of the present invention.

FIGS. 1, 2 and 3 show a block, generally indicated at 10, for 24 connector locations, arranged in a four by six array. That is, front to back of the block there are four columns of connector locations, each of which has six rows from side to side. While the details which make up these four columns and six rows will be discussed in more detail hereinafter, the four columns are generally indicated at 12(*a*) through 12(*d*) in FIG. 1, and the six rows are generally indicated at 14(*a*) through 14(*f*) in FIG. 2. Of course, it will be understood that any desired number of rows and columns can be used, and the four by six array is merely for purposes of illustration.

Figure 1A:
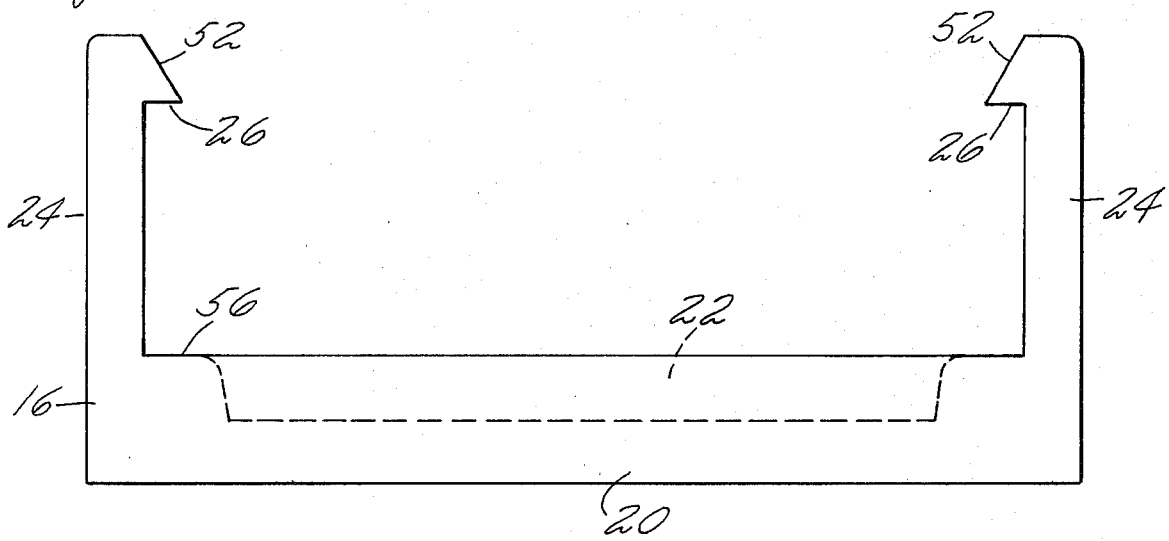
FIGS. 1(A) and 1(B) are views similar to FIG. 1 showing the retainer and main body sections, respectively, of the mounting block.

Block 10 is made up of two basic interlocking parts. These two parts are a retainer 16 and a main body unit 18, both of which are molded plastic elements. For purposes of clarity and understanding, retainer 16 and main body unit section 18 are separately shown in FIGS. 1(A) and 1(B) respectively, FIGS. 1(A) and 1(B) corresponding to separate parts of the assembled unit shown in FIG. 1. Retainer 16 has a base portion 20 with a series of latitudinal (side to side) slots 22 therein corresponding to the number of rows of wire formed connectors to be housed in the block. Retainer 16 also has a plurality of locking arms 24 which extend upwardly from base 20 along each side of the retainer. Locking arms 24 are slightly resilient and springy, so that they can be deflected outwardly and then spring or snap back into place to lock retainer 16 and main body unit 18 together. The upper part of each lock arm 24 has an inwardly projecting locking surface or shoulder 26 to engage with and lock with a corresponding locking surface or shoulder 28 on main body unit 18.

Main body unit 18 has a main body portion 30 with a fanning strip, comprised of posts 32, running along each side, the fanning strips serving as a means of orderly entry into the block for insulated electrical wire conductors which are to be connected to solderless connectors in the block. Main body unit 18 includes, in body portion 30, a plurality of longitudinal slots 34 which correspond to and are in alignment with each of the longitudinal slots 22 in base 20. Body unit 18 has an internal floor or surface area 36 from which a series of inverted U-shaped bridges 38, which are integrally molded parts of main body unit 18, project. The outermost of bridges 38 are integral with posts 32 of the fanning strip. Each bridge 38 has a passage or opening 40 in alignment with the slots 22 and 34. As will be described in more detail hereinafter, the slots 22 and 34 and the passages 40 serve to house and position the rows of wire formed solderless connectors to be mounted in the block. Thus, in the embodiment shown in the drawings, there are six rows of slots 22 and 34, with the passages 40 of the bridges 38 in each row being aligned with respect to slots in each row. Each bridge 38 can be considered to be made up of a pair of uprights 42 and 44 joined together by a cross piece 46. It will, of course, be understood that all of the bridging elements 38 are of similar construction, so only illustrative ones are marked in the drawings. As best shown in FIG. 3, the bridges are spaced apart to define (1) spaced open rows 43 in which to run conductor wires from the fanning strips and (2) spaced open columns 45 through which access is had to connect conductor wires to the connector strips housed in the block.

In assembling a block in accordance with the present invention, solderless connectors 48 formed from a length of conductive wire, one of such row type connectors being clearly seen from FIG. 1, are loaded into the slots 34 and bridge passages 40 of main body unit 18. Retainer 16 is then placed in position relative to the main body unit, with the slots 22 in alignment with the wire strips, and the base and main body unit are then moved together to come into locking engagement. As can best be seen in FIG. 1, the innermost extension of shoulder or surface 26 on the locking arms 24 overlaps main body surfaces 50 over which the arms must slide in assembling the unit. Thus, when assembling the unit, the inclined surfaces 52 on arms 24 will be engaged by surfaces 50, whereby the locking arms 24 are cammed and deflected outwardly as retainer 16 and main body unit 18 are moved together. When the retainer and main body unit have been positioned so that the bottom 54 of body portion 30 is adjacent to the top 56 of retainer body 20, the locking arms snap inwardly with locking surfaces 26 overlapping locking surfaces 28 to complete the assembly of the block. In this manner, the wire formed connector strips are locked and retained in place in the block and are ready to receive single or plural, insulated or bare, single conductor or stranded wires to be mounted thereon.

Figure 4:
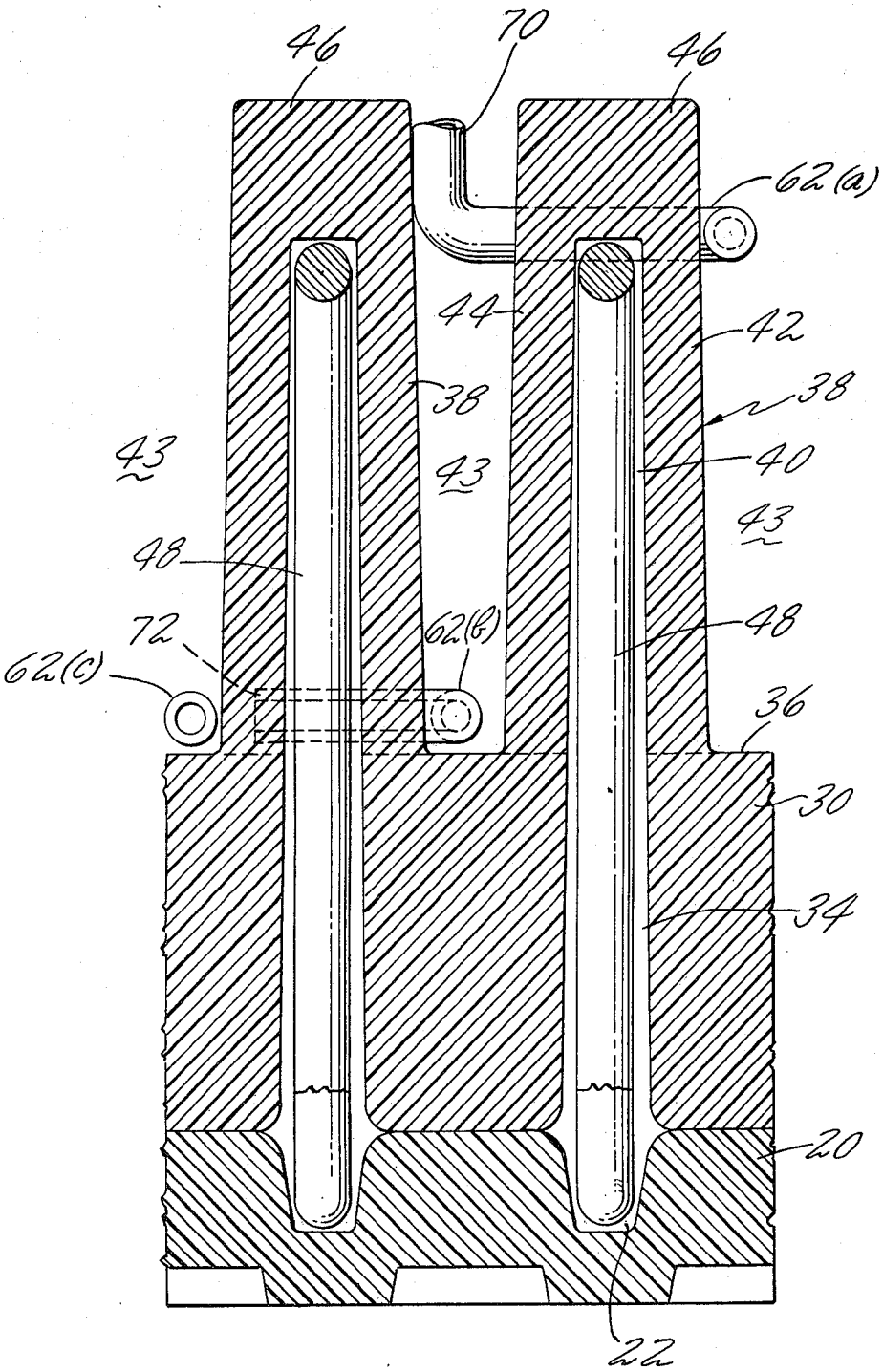
FIG. 4 is a partial sectional detail taken along line 4—4 of FIG. 3.

With particular attention to FIGS. 2 and 4, an important feature of the invention is illustrated in that each row of wire formed connectors is fully retained against movement or deflection toward any adjacent row, since the lower loops of each wire connector row are fully captured in a slot 22 and the connector rows are also captured in slots 34 and the bridge passages 40 in the bridges 38. Thus, each wire connector row is fully constrained against displacement which would create misalignment and interfere with the insertion of conductor wires. Also, the bridges, especially cross pieces 46, shield the wire connectors and prevent short circuiting by outside objects which might fall into or otherwise come into contact with the top of the block, this protection being realized without the need for a separate cover on the block.

The present invention not only retains each row of wire-formed connectors against deflection toward an adjacent row, but also resists lateral deflection of each connector row when a conductor is inserted therebetween. As clearly seen in FIGS. 1 and 2, each wire connector row is snuggly captured within slots 34 of main body 18 and passages 40 of U-shaped bridges 38. The upper loops at each end of each connector wire are retained against outward movement by the upper side walls 74 of the outermost of bridges 38. Each loop of each connector wire is also prevented from overlapping the adjacent loops by the uprights 42 and 44 of bridges 38 and thus the bridges function to stiffen the upper loops of the connectors.

The lateral retention and stiffening of the upper loops or portions of the wire-formed connectors 48 within the blocks 10 is an important feature of the present invention. Since the upper loop portions of the wire connectors are prevented from lateral movement when an electric wire is inserted therebetween, wire insertion results in a high compression force which strips away the insulation from the conductor of the wire. This compressive force decreases as the conductor is forced downwardly between a pair of cooperating loops of the connector, since the two straight portions of the wire connector are allowed to bend outwardly as shown in FIG. 1. This prevents cold flow of the conductor as it is inserted into the connector. Thus, to summarize, the loops of the wire-formed connector generate a high force upon initial wire insertion and the high force strips any insulation from the wire. When fully inserted, however, the wire is positioned between straight sections of the connector, i.e., between straight sections of end supported beams which can bend. The application of a force which is initially high and which decreases in the direction of wire insertion is completely contrary to prior art practice.

Another important feature attributable to the above-discussed lateral retention is that the insertion of two or more conductors between a single pair of loops of the connector will not force apart the upper loop portions. This assures that the insulation will be stripped away, even after repeated use. It should thus be apparent to those skilled in the art that even after repeated use of the connectors of the present invention, there will be no outward expansion of the upper loop portions which would diminish their insulation stripping function. Also, the connector blocks of the present invention will reliably receive and retain multiple electrical conductors at each connector location.

Figure 1B:
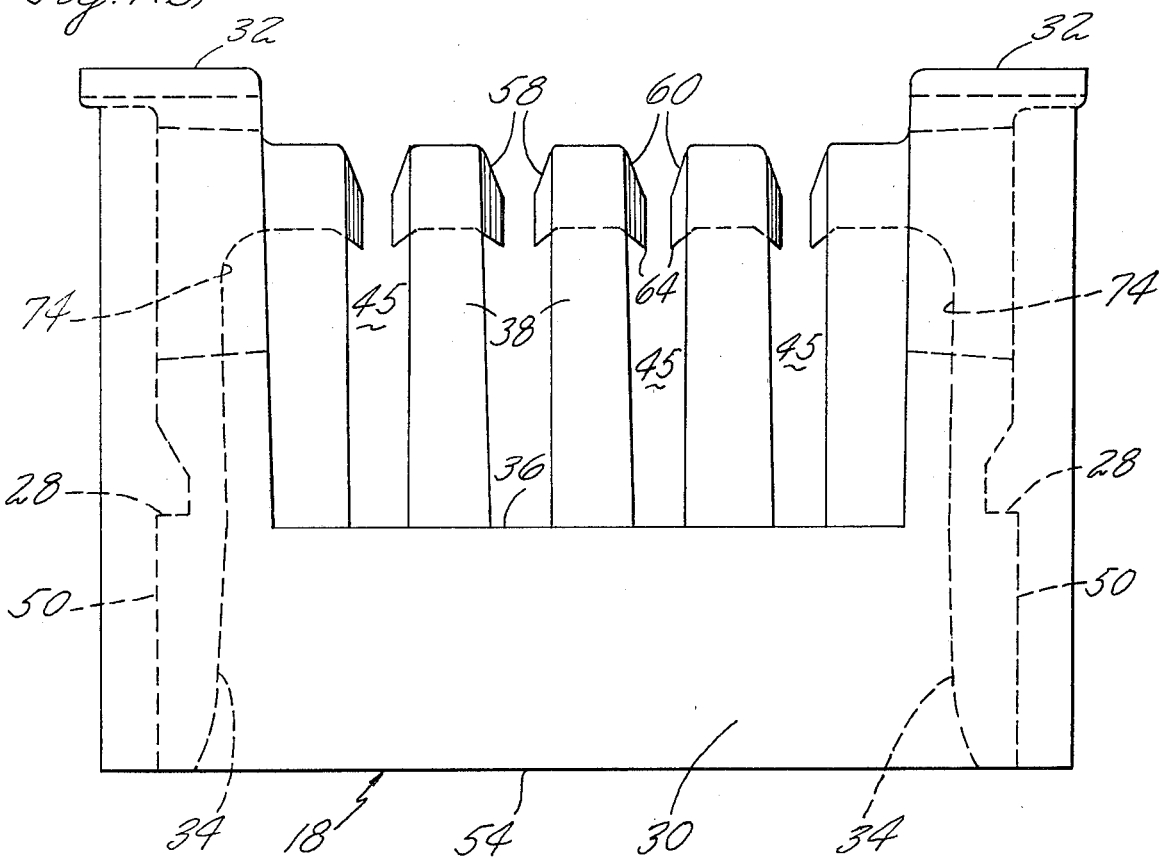

Referring now to FIGS. 1 and 1(B), another important feature of the present invention is illustrated in the presence of wings or projections 58 at the top part of each bridge 38. These wings 58 extend between and toward adjacent bridges within a row, so that they narrow the gap between adjacent bridges within each row. The tops of adjacent wings on adjacent bridges are inclined as indicated at 60 to define a lead in area or ramp to guide an electric wire into position for insertion in the connector block and electrical and mechanical attachment to the wire formed in the block. Illustrative insulated conductors which have been guided into place for eventual insertion and connection to a row connector are shown at 62 in FIG. 1. As can also be seen in FIG. 1(B), each wing 60 terminates in a downwardly pointed end surface 64 which serves as a retention mechanism to hold the electrical wire in place in anticipation of connection to the wire formed connector strip. This retention mechanism is effected due to the fact that the insulation covering 66 on wires 62 is slightly compressed as it passes through the opening defined by the wings between adjacent bridges, and the pointed ends 64 frictionally engage and retain the outer insulation of the wire. Thus, an important feature of the invention resides in the fact that a conductor to be inserted in the connector can be placed in the block in anticipation of eventual connection, and will be relatively firmly retained in place until the insertion-connection operation is actually performed. Thus, the winged extensions of the bridges serve both to provide lead ins for the wires 62 and retain the wires in place in anticipation of connection to the connectors in the block. The wires to be connected to the block will, typically, be lead into the block through the spaces 68 of the fanning strips, and the wires will then be laid into the position discussed immediately above with respect to wires 62 of FIG. 1 in anticipation of eventual connection to the wire-formed connector strip 48.

The actual mechanical and electrical connection of the conductor of a wire 62 to a connector strip will, typically, be effected by means of a wire insertion tool somewhat similar to the general type presently used for inserting wires into "66 Type" connectors of the type shown in U.S. Pat. No. 3,132,913. A tool designed for use with the connector block of the present invention is disclosed in my co-pending application Ser. No. 233,983 filed February 12, 1981 and assigned to the assignee of the present invention. Mechanical and electrical connection of the conductor of wire 62 to the connector strip 48 is effected by forcing the wire 62 downwardly between adjacent loops of wire connector 48. The wire 62 will typically be forced down to floor 36. As this happens, as described above, the insulation 66 is sheared and adjacent straight sections of the loops of the connector are subsequently urged apart, and generate strong spring return forces, so that firm physical and electrical contact is established between the conductor of wire 62 and the adjacent loop surfaces of the wire formed connector. As may also be seen in FIG. 1, and as also discussed above, a particularly useful feature of connectors in accordance with the present invention resides in the fact that two or more conductors may be mounted at a single station in the block.

Referring to FIG. 4, a wire 62(*a*) is shown in position in the row on the right in anticipation of eventual connection to a wire formed connector strip 48. In the position as shown, conductor 62(*a*) has been led in from a fanning strip, positioned along a row 43 between adjacent rows of bridges 38, and is being retained in position between the pointed ends of wings 58 (not shown on FIG. 4 but depicted in FIG. 1(B). A loose end 70 of the wire 62(*a*) extends toward the next (i.e., left) row of connector strips. Still referring to FIG. 4, the leftmost row shows a conductor 62(*b*) is shown positioned at the bottom of a spaced row 43 after it has been inserted into the wire formed connector strip and connected thereto mechanically and electrically. The wire insertion tool which would typically be used to complete the wire connection may have a cutoff blade which will react against table 36 to sever the loose end of the electrical conductor at 72. As can also be seen in FIG. 4, the end 72 of the wire may be severed at a position where it extends past the wire formed connector strip 48, the extension contributing to the strength of the mechanical connection, while still being within the confines of the bridge uprights 42 so that there is no interference with an adjacent conductor 62(*c*) which runs along the next spaced row 43 between rows of bridges. Thus, each conductor wire may be positioned and severed with the confidence that the cutting blade will not cut into the running wire in the next row.

While a preferred embodiment has been shown and described, various modifications and substitutions may be made thereto without departing from the spirit and scope of the invention. Accordingly, it is to be understood that the present invention has been described by way of illustration and not limitation.

What is claimed is:

1. A block for housing connector elements formed from electrically conductive stock of circular cross-section, the block including:

a retainer section;

a plurality of substantially parallel spaced slots in said retainer section;

a main body section;

a plurality of substantially parallel spaced slots in said main body section, said body section slots each being in alignment with a corresponding slot in said retainer section;

a plurality of bridge elements on said main body section, said bridge elements each being in alignment with a main body section slot, each bridge element defining a passage in registration with the main body section slot with which it is aligned;

said corresponding retainer section slots, main body section slots and bridge element passages cooperating to define housings for the connector elements;

the bridge elements which are in alignment with each slot being spaced apart and being in alignment with the bridge elements which are in alignment with other body section slots to define spaced columns which guide electrical conductors to connector elements which are to be inserted in said block; and means for releasably joining said retainer section to said main body section.

2. A block as in claim 1 wherein:

said main body section has a floor spaced from said retainer section; and said bridge elements extend from said floor away from said retainer section.

3. A block as in claim 1 further including:

fanning strips on the sides of said main body section;

said fanning strips defining conductor entry passages in alignment with the spaces disposed between rows of said bridge elements.

4. A block as in claim 1 wherein:

said releasable joining means includes locking arms extending from said retainer section, and locking surfaces on said main body section for locking engagement with said locking arms.

5. A block for housing connector elements formed from electrically conductive stock of circular cross-section, the block including:

a retainer section;

a main body section, said body section defining a plurality of generally parallel slots;

means releasably connecting said retainer section to said main body section;

projecting means extending from said main body section and cooperating with the slots in said main body section to define housings for rows of the connector elements; and said projecting means being aligned to define spaced columns and rows of connector locations in said block.

6. A block as in claim 5 wherein:

said projecting means includes bridge elements with passages therein in alignment with the slots in said main body section.

7. A block as in claim 6 wherein:

said main body section has a floor spaced from said retainer section; and said bridge elements extend from said floor away from said retainer section.

8. A block as in claim 6 further including:

fanning strips on the sides of said main body sections;

said fanning strips defining conductor entry passages in alignment with the spaces between rows of said bridge elements.

9. A block as in claim 6 wherein:

said releasable connecting means includes locking arms extending from said retainer section, and locking surfaces on said main body section for locking engagement with said locking arms.

10. An insulation piercing electrical connector comprising:

a housing formed of non-conductive material, said housing including a base portion and a pair of oppositely disposed side walls extending upwardly therefrom, said side walls being provided with facing generally U-shaped grooves, said housing further having at least a first projection extending outwardly from said base portion in the same direction as said side walls, said projection having a slot extending therethrough, said slot being in registration with said side wall grooves; and a connector element, said connector element being formed from a resilient electrically conductive wire stock of circular cross-section, said connector element defining a series of interconnected loops arranged in co-planar relationship, said loops each having two straight parallel side portions, the straight side portions of adjacent loops being in an abutting relationship, said connector element being positioned in said housing with the outermost straight side portions of the opposite end loops of the series disposed in said U-shaped grooves and an intermediate loop at least partly disposed in said slot in said first projection, abutting straight side portions of adjacent loops being disposed to either side of said first projection whereby an insulated electrical conductor may be forced therebetween, the slot defining walls of said housing projection and said U-shaped grooves preventing lateral movement of adjacent loops of said connector element and stiffening said connector element whereby a compressive force with decreases in the direction of insertion will be applied to an insulated electrical conductor inserted between a pair of adjacent loops, said force being sufficient to remove the insulation from the conductor and subsequently capture the conductor between the abutting straight side portion of adjacent loops.

11. The connector of claim 10 wherein said housing projection comprising an inverted U-shaped element having uprights joined together by a cross piece.

12. The connector of claim 10 wherein said housing base portion is slotted and said sidewalls also extend downwardly therefrom to define a recess below said base portion, said connector element extending partly through said slotted portion and into said recess whereby the straight abutting side portions of adjacent connector element loops intercept the plane of said base portion and said base portion may function as an anvil against which an electrical conductor inserted in the connector may be cut.

13. The connector of claim 11 wherein said housing base portion is slotted and said sidewalls also extend downwardly therefrom to define a recess below said base portion, said connector element extending partly through said slotted portion and into said recess whereby the straight abutting side portions of adjacent connector element loops intercept the plane of said base portion and said base portion may function as an anvil against which an electrical conductor inserted in the connector may be cut.

14. The connector of claim 12 wherein said housing further comprises:

a releasable retainer, said retainer spanning said recess below said base portion and defining the length of said connector element which extends through said base portion slot.

15. The connector of claim 14 wherein said retainer is provided with a connector element receiving slot which facing into said recess, said retainer slot being in alignment with the slot in said first projection.

16. The connector of claim 14 wherein said retainer is provided with a connector element receiving slot which faces into said recess, said retainer slot being in alignment with the slot in said first projection.

17. A block for housing connector elements formed from electrically conductive stock of circular cross-section, the block including:

a retainer section;

a plurality of substantially parallel spaced slots in said retainer section;

a main body section, said main body section having a floor spaced from said retainer section;

a plurality of substantially parallel spaced slots in said main body section, said body section slots each being in alignment with a corresponding slot in said retainer section;

a plurality of bridge elements on said main body section, said bridge elements each being in alignment with a main body section slot, each bridge element defining a passage in registration with the main body section slot with which it is aligned;

said bridge elements extending from said floor away from said retainer section, and each of said bridge elements being an inverted U-shaped element integrally molded with the block and having uprights joined together by a cross piece;

said corresponding retainer section slots, main body section slots and bridge element passages cooperating to define housings for the connector elements;

the bridge elements which are in alignment with each slot being spaced apart and being in alignment with the bridge elements which are in alignment with other body section slots to define spaced columns which guide electrical conductors to connector elements which are to be inserted in said block; and means for releasably joining said retainer section to said main body section.

18. A block for housing connector elements formed from electrically conductive stock of circular cross-section, the block including:

a retainer section;

a plurality of substantially parallel spaced slots in said retainer section;

a main body section;

a plurality of substantially parallel spaced slots in said main body section, said body section slots each being in alignment with a corresponding slot in said retainer section;

a plurality of bridge elements on said main body section, said bridge elements each being in alignment with a main body section slot, each bridge element defining a passage in registration with the main body section slot with which it is aligned;

each of said bridge elements being an inverted U-shaped element integrally molded with the block and having uprights joined together by a cross piece;

said corresponding retainer section slots, main body section slots and bridge element passages cooperating to define housings for the connector elements;

the bridge elements which are in alignment with each slot being spaced apart and being in alignment with the bridge elements which are in alignment with other body section slots to define spaced columns which guide electrical conductors to connector elements which are to be inserted in said block; and means for releasably joining said retainer section to said main body section.

19. A block for housing connector elements formed from electrically conductive stock of circular cross-section, the block including:

a retainer section;

a plurality of substantially parallel spaced slots in said retainer section;

a main body section;

a plurality of substantially parallel spaced slots in said main body section, said body section slots each being in alignment with a corresponding slot in said retainer section;

a plurality of bridge elements on said main body section, said bridge elements each being in alignment with a main body section slot, each bridge element defining a passage in registration with the main body section slot with which it is aligned;

said bridge elements in alignment with each body section slot having projections on the top thereof extending toward adjacent bridge elements aligned with the same body section slot;

said corresponding retainer section slots, main body section slots and bridge element passages cooperating to define housings for the connector elements;

the bridge elements which are in alignment with each slot being spaced apart and being in alignment with the bridge elements which are in alignment with other body section slots to define spaced columns which guide electrical conductors to connector elements which are to be inserted in said block; and means for releasably joining said retainer section to said main body section.

20. A block as in claim 19 wherein:

said projections on adjacent bridge elements cooperate to define a lead in area for insertion of a wire including an electrical conductor.

21. A block as in claim 20 wherein:

said projections on adjacent bridge elements cooperate to define retaining means to retain a wire including an electrical conductor therebetween prior to connections to a connector element.

22. A block as in claim 19 wherein:

said projections on adjacent bridge elements cooperate to define retaining means to retain a wire including an electrical conductor therebetween prior to connection to a connector element.

23. A block as in claim 19 wherein:

facing projections on adjacent bridge elements define a space in alignment with conductor receiving portions of a connector element housed in the block.

24. A block for housing connector elements formed from electrically conductive stock of circular cross-section, the block including:

a retainer section;

a main body section having a floor spaced from said retainer section, said body section defining a plurality of generally parallel slots;

means releasably connecting said retainer section to said main body section;

projecting means extending from said main body section and cooperating with the slots in said main body section to define housings for rows of the connector elements;

said projecting means being aligned to define spaced columns and rows of connector locations in said block, said projection means including bridge elements with passages therein in alignment with the slots in said main body section; and said bridge elements extending from said floor away from said retainer section, each of said bridge elements being an inverted U-shaped element having uprights joined together by a cross piece.

25. A block for housing connector elements formed from electrically conductive stock of circular cross-section, the block including:

a retainer section;

a main body section, said body section defining a plurality of generally parallel slots;

means releasably connecting said retainer section to said main body section;

projecting means extending from said main body section and cooperating with the slots in said main body section to define housings for rows of the connector elements;

said projecting means being aligned to define spaced columns and rows of connector locations in said block, said projecting means including bridge elements with passages therein in alignment with aligned slots in said main body section and said retainer section; and each of said bridge elements being an inverted U-shaped element having uprights joined together by a cross piece.

26. A block for housing connector elements formed from electrically conductive stock of circular cross-section, the block including:

a retainer section;

a main body section, said body section defining a plurality of generally parallel slots;

means releasably connecting said retainer section to said main body section;

projecting means extending from said main body section and cooperating with the slots in said main body section to define housings for rows of the connector elements;

said projecting means being aligned to define spaced columns and rows of connector locations in said block; and said projecting means in each row having projections at the top thereof extending toward adjacent bridge elements in the row.

27. A block as in claim 26 wherein:

said projections on adjacent of said projecting means cooperate to define a lead in area for insertion of a wire including an electrical conductor.

28. A block as in claim 27 wherein:

said projections on adjacent of said projecting means cooperate to define retaining means to retain a wire including an electrical conductor therebetween prior to connection to a connector element.

29. A block as in claim 26 wherein:

said projections on adjacent of said projecting means cooperate to define retaining means to retain a wire including an electrical conductor therebetween prior to connection to a connector element.

30. A block as in claim 26 wherein:

facing projections on adjacent of said projecting means define a space in alignment with conductor receiving portions of a connector element housed in the block.

31. A block for housing connector elements formed from electrically conductive stock of circular cross-section, the block including:

a retainer section;

a plurality of substantially parallel spaced slots in said retainer section;

a main body section;

a plurality of substantially parallel spaced slots in said main body section, said body section slots each being in alignment with a corresponding slot in said retainer section;

a plurality of bridge elements on said main body section, said bridge elements each being in alignment with a main body section slot, each bridge element defining a passage in registration with the main body section slot with which it is aligned;

said corresponding retainer section slots, main body section slots and bridge element passages cooperating to define housings for the connector elements;

the bridge elements which are in alignment with each slot being spaced apart and being in alignment with the bridge elements which are in alignment with other body section slots to define spaced columns which guide electrical conductors to connector elements which are to be inserted in said block;

means for releasably joining said retainer section to said main body section;

connector elements disposed in said body section slots, said connector elements each being formed from electrically conductive stock of circular cross-section and defining a plurality of interconnected connectors; and each of said slots in said main body section being dimensioned to restrain a connector element disposed therein from lateral movement.

32. A block as in claim 31 wherein said bridge elements are aligned in rows and wherein the passages in the bridge elements at the opposite ends of each row are in the form of U-shaped slots, the connector elements engaging the bottoms of said U-shaped slots.

33. A block for housing connector elements formed from electrically conductive stock of circular cross-section, the block including:

a retainer section;

a main body section, said body section defining a plurality of generally parallel slots;

means releasably connecting said retainer section to said main body section;

projecting means extending from said main body section and cooperating with the slots in said main body section to define housings for rows of the connector elements;

said projecting means being aligned to define spaced columns and rows of connector locations in said block;

connector elements disposed in said body section slots, said connector elements each being formed from electrically conductive stock of circular cross-section and defining a plurality of interconnected connectors; and each of said slots in said main body section being dimensioned to restrain a connector element disposed therein from lateral movement.

34. A block as in claim 33 wherein said projecting means includes bridge elements with passages therein, said bridge elements being aligned in rows and wherein the passages in the bridge elements at the opposite ends of each row are in the form of U-shaped slots, the wire connector elements engaging the bottoms of said U-shaped slots.

* * * * *